US009797197B1

(12) United States Patent
Eddy

(10) Patent No.: US 9,797,197 B1
(45) Date of Patent: Oct. 24, 2017

(54) MOTOR ROTARY STEERABLE SYSTEM

(71) Applicant: William Alvan Eddy, Houston, TX (US)

(72) Inventor: William Alvan Eddy, Houston, TX (US)

( * ) Notice: Subject to any disclaimer, the term of this patent is extended or adjusted under 35 U.S.C. 154(b) by 252 days.

(21) Appl. No.: 14/876,777

(22) Filed: Oct. 6, 2015

Related U.S. Application Data

(60) Provisional application No. 62/071,916, filed on Oct. 6, 2014.

(51) Int. Cl.

| | |
|---|---|
| ***E21B 4/02*** | (2006.01) |
| ***E21B 7/06*** | (2006.01) |
| ***E21B 47/01*** | (2012.01) |
| ***E21B 47/12*** | (2012.01) |
| ***E21B 3/00*** | (2006.01) |
| ***E21B 4/00*** | (2006.01) |
| ***E21B 47/024*** | (2006.01) |

(52) U.S. Cl.
CPC ..... *E21B 7/068* (2013.01); *E21B 3/00* (2013.01); *E21B 4/00* (2013.01); *E21B 4/02* (2013.01); *E21B 7/06* (2013.01); *E21B 7/061* (2013.01); *E21B 47/024* (2013.01); *E21B 47/12* (2013.01)

(58) Field of Classification Search
CPC ... E21B 4/02; E21B 7/06; E21B 7/067; E21B 7/068; E21B 7/10; E21B 47/01; E21B 47/12
See application file for complete search history.

(56) References Cited

U.S. PATENT DOCUMENTS

| | | | | |
|---|---|---|---|---|
| 5,738,178 | A * | 4/1998 | Williams | E21B 4/02 175/61 |
| 5,934,383 | A * | 8/1999 | Jurgens | E21B 7/06 173/91 |
| 6,047,784 | A * | 4/2000 | Dorel | E21B 7/068 175/61 |
| 8,714,245 | B2 * | 5/2014 | Sihler | E21B 4/006 166/255.2 |
| 9,631,430 | B2 * | 4/2017 | Strittmatter | E21B 4/006 |
| 2005/0023037 | A1 * | 2/2005 | Camp | E21B 7/067 175/61 |

(Continued)

FOREIGN PATENT DOCUMENTS

| | | | | |
|---|---|---|---|---|
| EP | 2505765 | A1 * | 10/2012 | B60K 7/0015 |
| GB | 2454700 | A * | 5/2009 | E21B 4/02 |

*Primary Examiner* — Frederick L Lagman
(74) *Attorney, Agent, or Firm* — Buskop Law Group, P.C.; Wendy Buskop

(57) ABSTRACT

A motor rotary steerable system having a sun gear shaft, a pair of planetary gears rotated by the sun gear shaft, an adjustable slip clutch assembly rotated by the planetary gears in an opposite direction, and an orienting device connected to the planetary gears and adjustable slip clutch assembly. The orienting device comprises a bent sub with a bent sub housing, a bearing section, a bit drive assembly, a pulse counter to count the rotating drive shaft rotations, a drilling bit locator, and a transmitting device conveying signals from the orienting device to a receiver in an opposite side of a power section. The orienting device rotates independently from a drill string and is synchronously timed to the rotation of the drill string to rotate continuously while producing both straight and curved bore path segments and increase production rates.

14 Claims, 6 Drawing Sheets

(56) References Cited

U.S. PATENT DOCUMENTS

| | | | | |
|---|---|---|---|---|
| 2007/0119630 | A1* | 5/2007 | Hall | E21B 4/02 175/73 |
| 2007/0137897 | A1* | 6/2007 | Sanders | E21B 4/14 175/61 |
| 2008/0121432 | A1* | 5/2008 | Russell | E21B 41/0085 175/73 |
| 2008/0217062 | A1* | 9/2008 | Southard | E21B 4/006 175/57 |
| 2009/0050372 | A1* | 2/2009 | Hall | E21B 4/14 175/57 |
| 2010/0212966 | A1* | 8/2010 | Hall | E21B 4/006 175/106 |
| 2011/0100715 | A1* | 5/2011 | Koll | E21B 4/006 175/71 |
| 2011/0284292 | A1* | 11/2011 | Gibb | E21B 7/06 175/61 |

* cited by examiner 100
102
83
32
300
83
69
302
83
10b
10a
12
81
69
83
14
26
28
30
18
20
22
81
16
200

MOTOR ROTARY STEERABLE SYSTEM

CROSS REFERENCE TO RELATED APPLICATIONS

The present application claims priority to and the benefit of U.S. Provisional Patent Application Ser. No. 62/071,916 filed on Oct. 6, 2014, entitled "MOTOR ROTARY STEERABLE SYSTEM". This reference is incorporated herein in its entirety.

FIELD

The present embodiments generally relate to steerable drilling system for use on a drill string.

BACKGROUND

A need exists for a steerable drilling system which provides clockwise and counterclockwise rotation simultaneously.

The present embodiments meet these needs.

BRIEF DESCRIPTION OF THE DRAWINGS

The detailed description will be better understood in conjunction with the accompanying drawings as follows.

Figure 1:
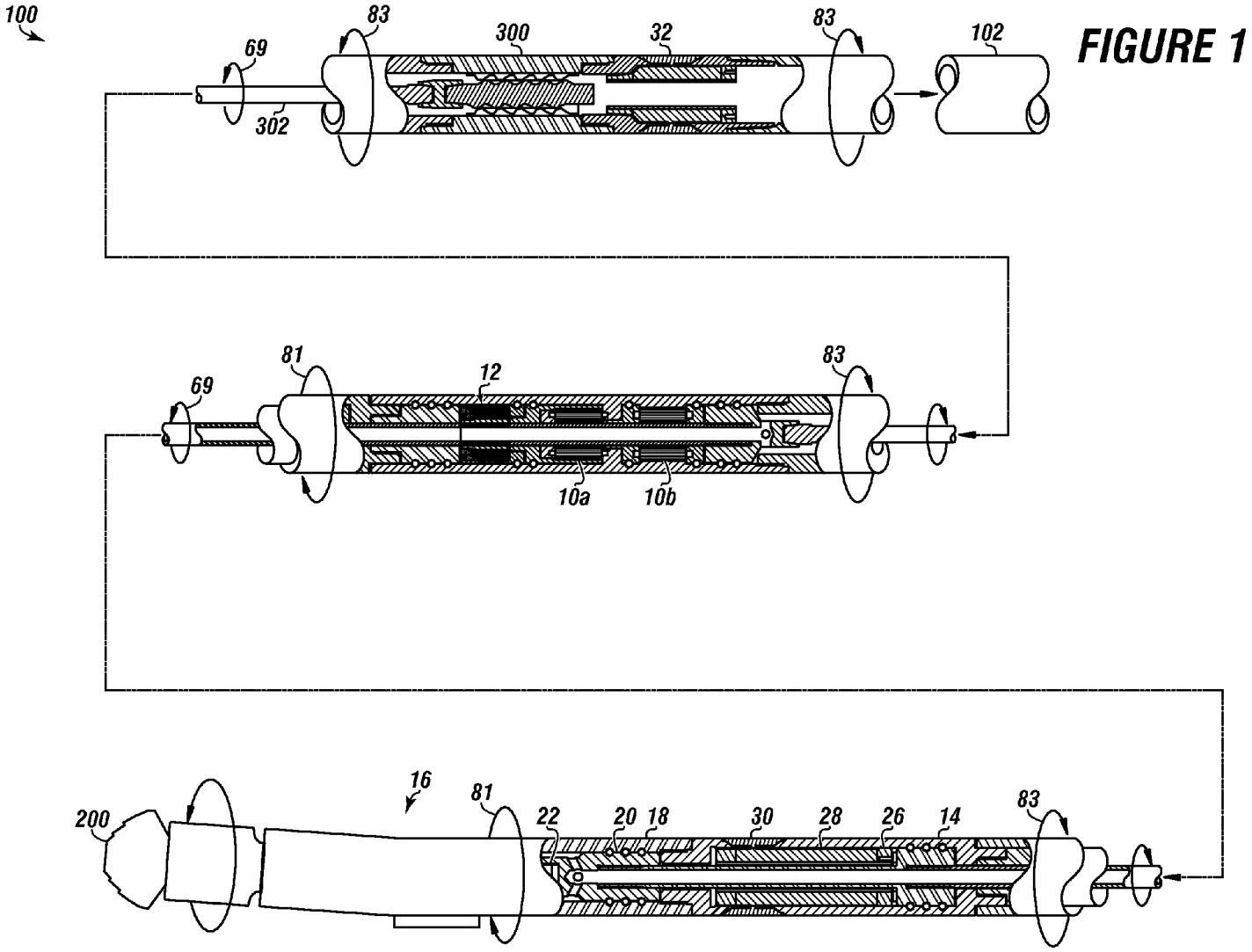
FIG. 1 depicts the motor rotary steerable system according to one or more embodiments.

The present embodiments are detailed below with reference to the listed Figures.

DETAILED DESCRIPTION OF THE EMBODIMENTS

Before explaining the present system in detail, it is to be understood that the system is not limited to the particular embodiments and that it can be practiced or carried out in various ways.

Specific structural and functional details disclosed herein are not to be interpreted as limiting, but merely as a basis of the claims and as a representative basis for teaching persons having ordinary skill in the art to variously employ the present invention.

The present embodiments generally relate to a steerable drilling system for use on a drill string having a drill bit.

The present embodiments can save lives on the drill floor by producing a cleaner, smoother wellbore that reduces explosions from the wellbore.

The present embodiments can reduce accidents at a drill site by reducing reactionary torque stored in the drill string.

The present embodiments can provide precise control of direction enabling a driller to remain in appropriate formations, which can reduce the chance of the driller being out of target and avoid dangerous pockets of hydrogen sulfide gas.

The present embodiments can help a driller avoid hitting salt water pockets which can generate a pollutant that must be carefully disposed of, or risk contaminating a water supply.

The term "rotating drill bit" as used herein can refer to a device that interacts with the geological formations for the purpose of making a hole in the earth.

The term "power section" as used herein can refer to a positive displacement motor.

The term "bent sub" as used herein can refer to a short cylindrical device installed in a drill pipe between a drill collar and a downhole motor. In embodiments, the bent sub can include a bent sub housing. The bent sub housing can contain a drive shaft. The drive shaft can include a bit box and a pair of constant velocity joints. In embodiments, the constant velocity joints can be u-joints.

The bent sub can also include a bearing section and a wear pad. The wear pad can prevent the bent sub housing from rubbing against the formations.

The term "planetary gear" as used herein can refer to one set of gears fixed into a rotatable carrier. Persons having ordinary skill in the art often refer to such gears as sun and planet gears.

The term "adjustable slip clutch assembly" as used herein can refer to an automatic device or attachment for regulating the speed of an engine or motor under varying conditions of load and pressure by controlling the flow of fluid, electric current, or varying the pressure, as water or gas. In embodiments, the adjustable slip clutch assembly can be a device for regulating the amount of torque transferred to the orienting device.

The term "bent sub housing" as used herein can refer to a housing designed for a positive-displacement downhole turbodrill.

The term "bearing section" as used herein can refer to a support of axial loads and radial loads during drilling. The bearing section can also transmit the torque and the rotary speed from a transmission shaft to the drill bit.

The term "bit drive assembly" as used herein can refer to a component of the bent sub housing that can rotate the drill string and make the drill bit drill a subsurface hole.

The term "pulse counter" as used herein can refer to a device, such as a hall effects sensor or a magnetic pick-up, able to detect proximity to a metallic part.

The term "drilling bit locator" as used herein can refer to a portion of a measurement while drilling device that can triangulate multiple accelerometers to determine the angle of a toolface.

The term "measurement while drilling device" as used herein can refer to a device that includes the drilling bit locator.

The term "transmitting device" as used herein can refer to a device that can transmit data signals from the drill bit locator to a receiver.

The embodiments relate to a motor rotary steerable system for directional drilling of sub-surface formations with a rotating drill bit.

The motor rotary steerable system can be positioned between a power section with a rotating drive shaft having a clockwise rotation that can be secured to a drill string and a bent sub.

The motor rotary steerable system can have a sun gear shaft.

The motor rotary steerable system can have a pair of planetary gears rotating in the clockwise rotation by the rotating drive shaft of the power section and by the sun gear shaft.

The motor rotary steerable system can have an adjustable slip clutch assembly rotated by the pair of planetary gears in a counterclockwise rotation.

The motor rotary steerable system can have an orienting device connected to the pair of planetary gears.

The orienting device can be configured to rotate in a counterclockwise rotation to engage with the adjustable slip clutch assembly.

The orienting device can include the bent sub.

The bent sub can have a bent sub housing, a bearing section in the bent sub housing, a bit drive assembly in the bent sub housing, a pulse counter to count the rotating drive shaft rotations in the bent sub housing, and a drilling bit locator performing measurement while drilling. The drilling bit locator can be disposed in the bent sub housing. Also, the bent sub can have a transmitting device in the bent sub housing to convey signals from the orienting device to a receiver in an opposite side the power section.

The orienting device can be rotated independently from the drill string. The orienting device can be geosynchronously timed to the rotation of the drill string to allow the drill string to rotate continuously while producing both straight and curved bore path segments to smooth a wellbore and increase production rates from the wellbore.

Figure 2:
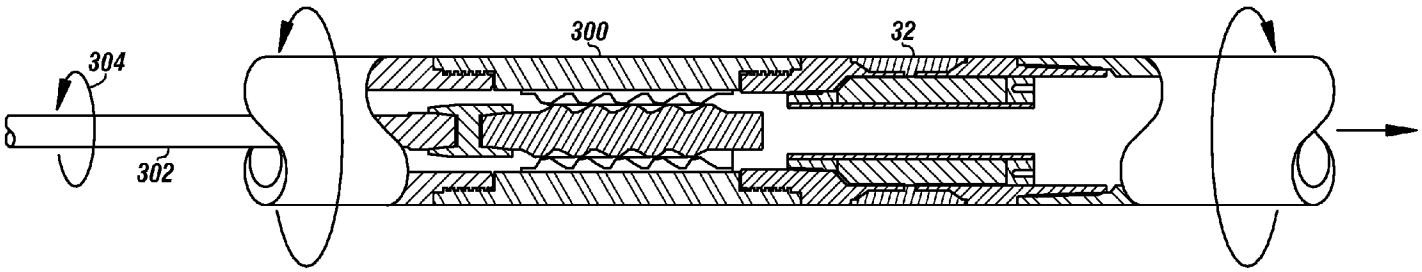
FIG. 2 depicts a cross section of the power section of the motor rotary steerable system for directional drilling of sub-surface formations according to one or more embodiments.
Figure 3A:
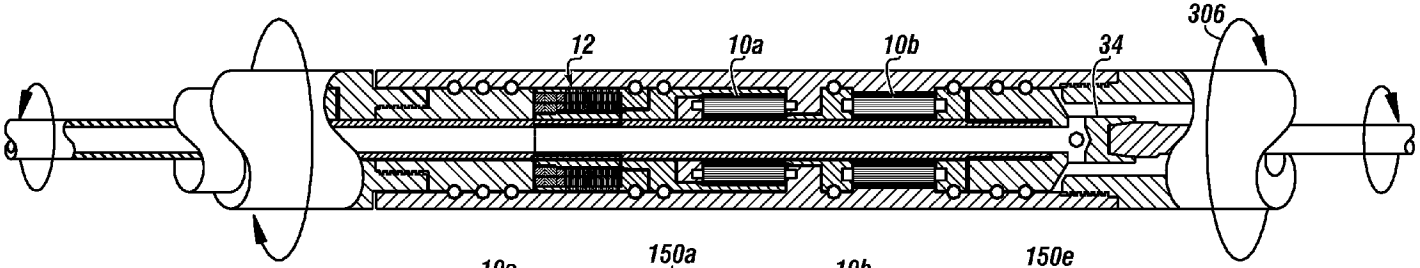
FIG. 3A depicts a cross section of the pair of planetary gears with an adjustable slip clutch assembly that attaches to the power section according to one more embodiments.
Figure 4:
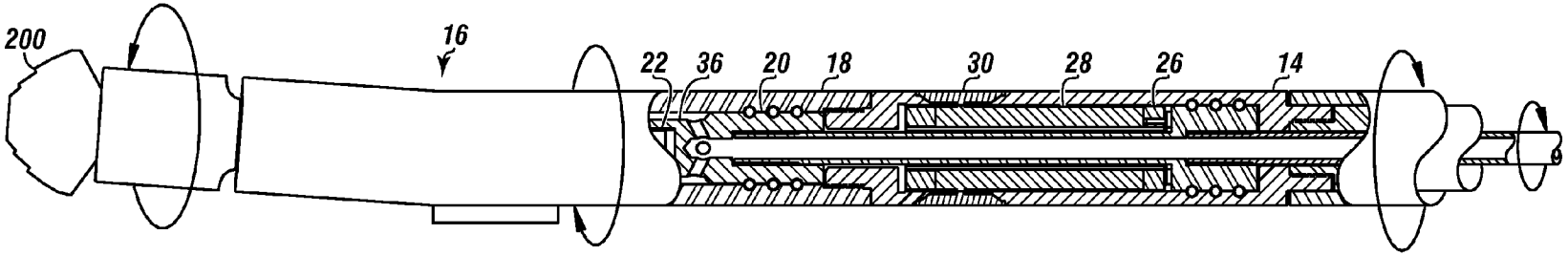
FIG. 4 depicts a cross section of the orienting device connected to a bent sub.

Turning now to the Figures, FIG. 1 depicts a motor rotary steerable system according to one or more embodiments. FIG. 2 depicts a cross section of the power section of the motor rotary steerable system for directional drilling of sub-surface formations according to one or more embodiments. FIG. 3A depicts a cross section of the pair of planetary gears with an adjustable slip clutch assembly that attaches to the power section according to one or more embodiments. FIG. 4 depicts a cross section of the orienting device connected to a bent sub.

In accordance with these Figures, a motor rotary steerable system 100 with a rotating drill bit 200 is shown. In embodiments, the motor rotary steerable system 100 can be positioned between a power section 300 with a rotating drive shaft 302, which can be secured to a drill string 102.

The string speed 86, the orienter speed 81, and the bit speed 69 are shown in relation to rotation.

The motor rotary steerable system 100 can have a receiver 32, which can be located in an opposite side of the power section 300. In embodiments, the receiver 32 can be a receiving antenna.

The rotating drive shaft 302 is shown having a counter clockwise rotation 304, in FIG. 2.

In embodiments, the rotation can be in accordance with the performance characteristics of the power section, which can determine maximum flow rates, minimum flow rates, maximum weight on bit, and allowable pressure drop.

A pair of planetary gears 10*a* and 10*b* can engage an adjustable slip clutch assembly 12.

In embodiments, the pair of planetary gears 10*a* and 10*b* can be rotated by the rotating drive shaft and a sun gear shaft 34.

A bent sub 16 can have a bent sub housing 18. A bearing section 20 and a bit drive assembly 22 can be located in the bent sub housing 18.

A pulse counter 26 can count the rotating drive shaft 302 rotations in the bent sub housing 18.

A drilling bit locator 28 can perform measurement while drilling, and the drilling bit locator can be disposed in the bent sub housing 18.

The drilling bit locator can include a short hop data sending device and a power supply. The drilling bit locator can measure gamma radiation and resistivity. The drilling bit locator can also measure accelerometer data to determine toolface.

A transmitting device 30 in the bent sub housing 18 can convey signals from an orienting device 14 to the receiver 32 in an opposite side of the power section 300.

The orienting device 14 can include a gamma ray projection and detection device 36, a short hop sending device, and a power supply. The orienting device can measure gamma radiation, resistivity, density, porosity, acoustic velocity, temperature, and pressure.

In embodiments, the orienting device can be adjacent to a measurement while drilling sub. The measurement while drilling sub can include a mud pulse transmitting device, a timing device, and a counting device. The timing device can measure time during a defined cycle period. The counting device can count pulses sensed during the defined cycle period.

Figure 3B:
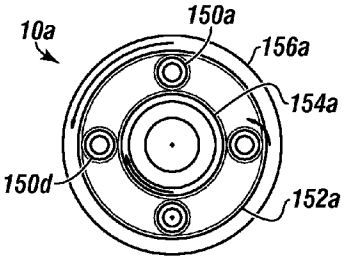
FIGS. 3B and 3C shows a planetary gear system usable with the motor rotary steerable system according to one or more embodiments.
Figure 3C:
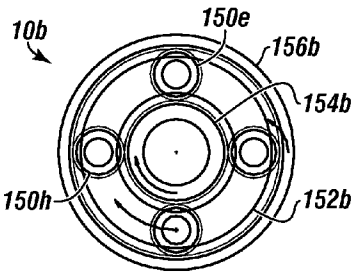

FIGS. 3B and 3C show a gear system usable with the system according to one or more embodiments.

Planetary gearing or epicyclic gearing as used herein can refer to a gear system consisting of one or more outer gears, or planet gears, revolving about a central, or sun gear. The planet gears can be mounted on a movable arm or carrier which itself can rotate relative to the sun gear.

In embodiments, the pair of planetary gears 10*a* and 10*b* can have a plurality of planet gears 150*a*-150*h*, which can each be supported by a carrier 152*a* and 152*b* and surrounded by a ring gear 156*a* and 156*b*. The carriers 152*a* and 152*b* can be fixed or driven. The planet gears 150*a*-150*h* can be driven.

Sun gears 154*a* and 154*b* can be surrounded by the plurality of planet gears 150*a*-150*h* and each of the carriers 152*a* and 152*b*. The sun gears 154*a* and 154*b* can be driven.

The plurality of planet gears 150*a*-150*h* can be surrounded by the ring gears 156*a* and 156*b*. The ring gears 156*a* and 156*b* can be fixed or driven.

In embodiments, the clockwise rotation 306 can be determined by the gear system or the pair of planetary gears, as shown in FIG. 3A.

In embodiments, the pair of planetary gears can be rotated by the rotating drive shaft of the power section and the sun gear shaft and the adjustable slip clutch assembly can be rotated by the pair of planetary gears in a direction opposite the rotation of the pair of planetary gears.

The orienting device can be rotated independently from the drill string and the orienting device can be synchronously timed to the rotation of the drill string to allow the drill string to rotate continuously while producing both straight and curved bore path segments to smooth a wellbore and increase production rates from the wellbore.

Figure 5:
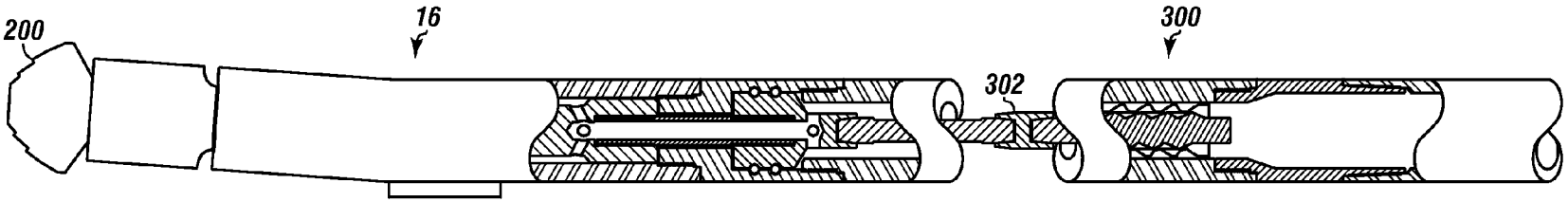
FIG. 5 is a cross section of the bent sub connected to the orienting device while engaging the power section.
Figure 6:
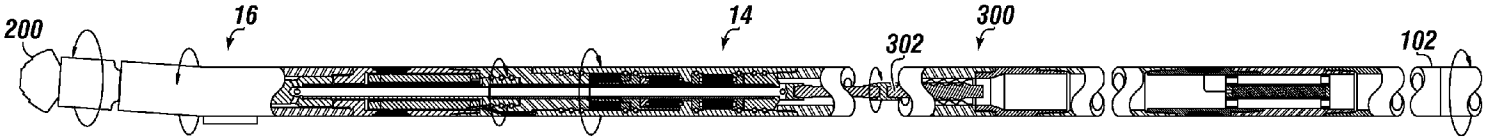
FIG. 6 a cross section of the bent sub connected to the orienting device while engaging with the power section.
Figure 7A:
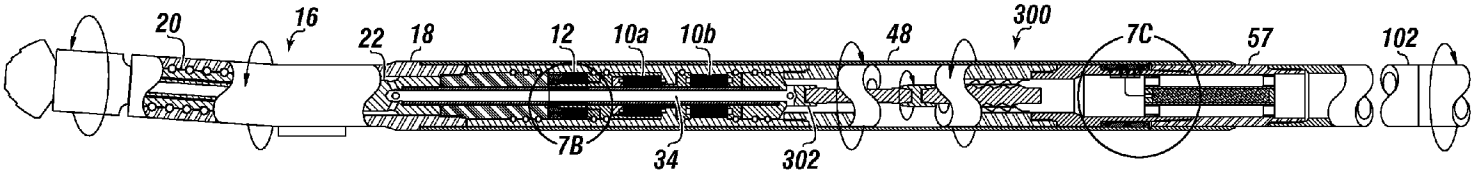
FIG. 7A is a cross section of the bent sub with the bent sub housing, wherein the motor rotary steerable system can include a sleeve attached to the orienting device.
Figure 7C:
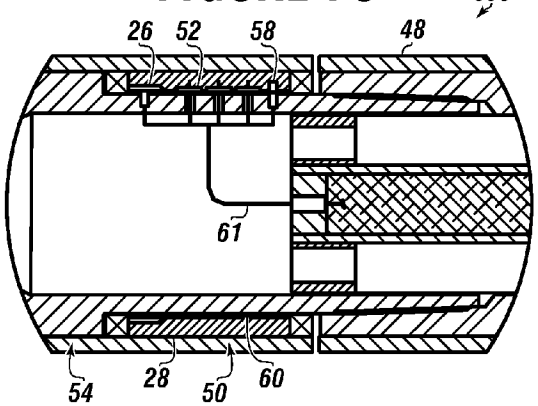
FIG. 7C is a detailed view of an electronics sub of FIG. 7A according to one or more embodiments.
Figure 7B:
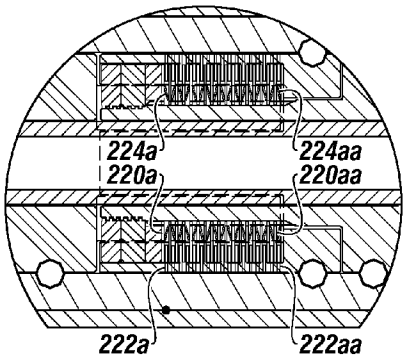
FIG. 7B is a detailed view of an adjustable slip clutch assembly of FIG. 7A according to one or more embodiments.

FIG. 5 shows a cross section of the bent sub 16 connected to the orienting device 14 while engaging the power section 300. FIG. 6 shows a cross section of the bent sub 16 connected to the orienting device 14 while engaging with the power section 300. FIG. 7A is a cross section of the bent sub 16 with the bent sub housing 18, wherein the motor rotary steerable system can include a sleeve 48 attached to the orienting device 14 and the measurement while drilling device 57. FIG. 7B is a detailed view of an adjustable slip clutch assembly 12 of FIG. 7A according to one or more embodiments. FIG. 7C is a detailed view of an electronics sub 54 of FIG. 7A according to one or more embodiments.

The bent sub 16 with the bent sub housing 18 is shown connected to the orienting device 14. The bearing section 20 and the bit drive assembly 22 can be located in the bent sub housing 18.

In accordance with these Figures, an orienter extension assembly 303 can include a sleeve 48 and an electronics pod 50. The sleeve 48 can surround the orienting device 14 and the power section 300.

The electronics pod 50 can include the measurement while drilling device 57 with the drilling bit locator 28. The electronics pod 50 can also include a plurality of rotatable electrical contact brushes 52. The plurality of rotatable electrical contact brushes 52 can transmit data from the drilling bit locator 28. The data can be transmitted to the electronics sub 54.

The electronics sub 54 can be positioned between the power section 300 and the measurement while drilling device 57. The orienting device 14 can be rotated independently from the drill string 102. The orienting device can be geosynchronously timed to the rotation of the drill string 102 to allow the drill string to rotate continuously while producing both straight and curved bore path segments to smooth a wellbore and increase production rates from a wellbore.

The rotating drive shaft 302, the rotating drill bit 200, the pair of planetary gears 10*a* and 10*b* and the sun gear shaft 34 are shown.

FIG. 7B is a detailed view of an adjustable slip clutch assembly of FIG. 7A according to one or more embodiments.

The adjustable slip clutch assembly 12 can have a plurality of pressure plates 220*a*-220*aa*. The plurality of pressure plates can be engaged with a plurality of friction plates 222*a*-222*aa*. A plurality of biasing means 224*a*-224*aa* can be positioned between the plurality of pressure plates 220*a*-220*aa* and the plurality of friction plates. The plurality of biasing means 224*a*-220*aa* can collapse when pressure is applied to the plurality of pressure plates.

FIG. 7C is a detailed view of the electronics sub of FIG. 7A according to one or more embodiments.

The electronics sub 54 can contain the pulse counter 26 and a high side position sensor 58. The pulse counter 26 can count orienter extension assembly 303 rotations. The high side position sensor 58 can be configured to transmit a signal to activate an indicator light when magnetic north is aligned with a high side of the bent sub. The electronics sub can also contain a plurality of rotatable electrical contact rings 60 disposed in the electronics sub 54 configured to align with the plurality of rotatable electrical contact brushes 52 in the electronics pod 50. The electronics sub can also include a wiring harness 61 that can provide an electrical interface between the electronics sub 54 and the drilling bit locator 28.

Figure 8:
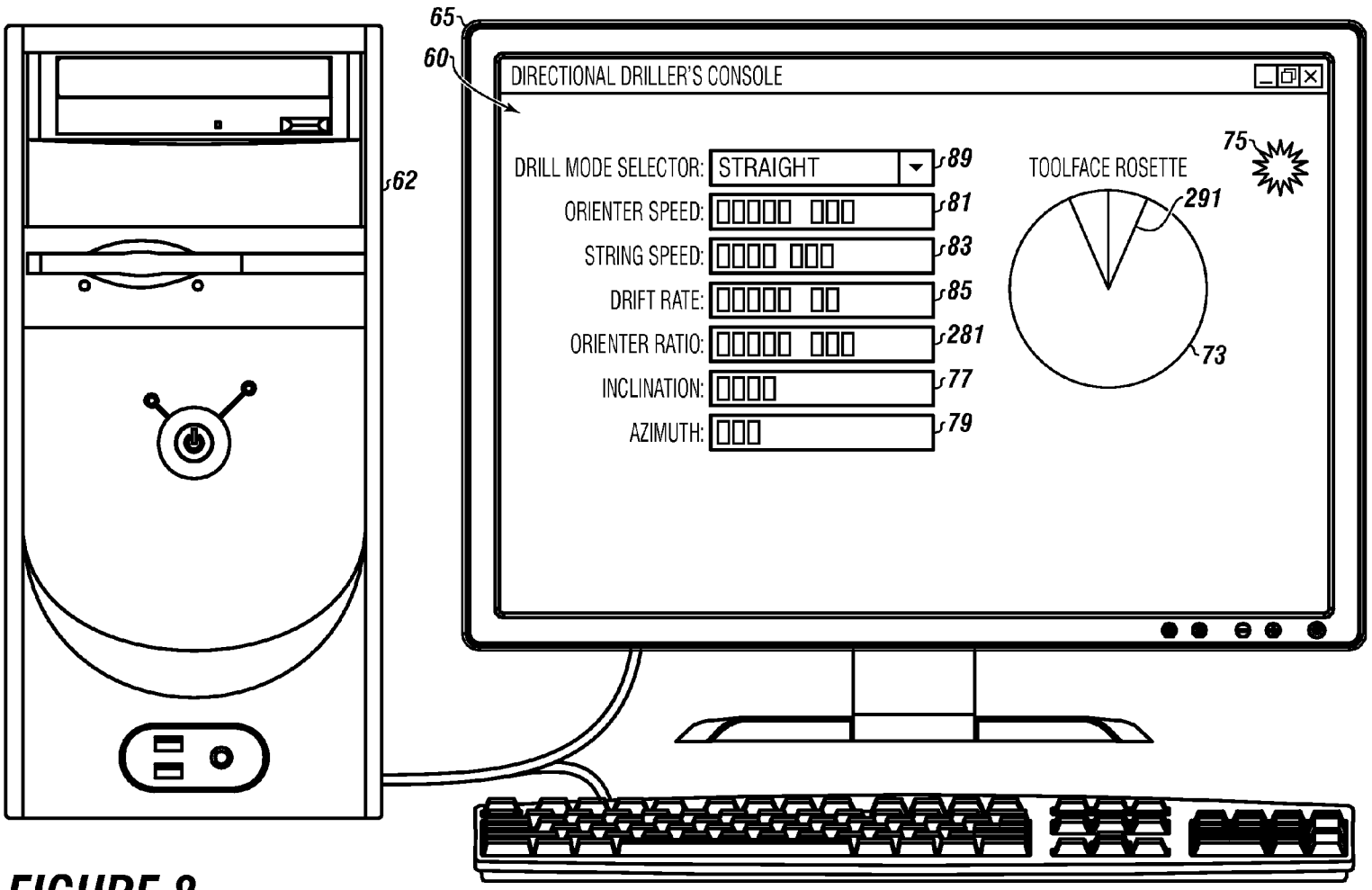
FIG. 8 shows a diagram of a directional driller's console according to one or more embodiments.

FIG. 8 shows a diagram of a directional driller's console according to one or more embodiments.

A directional driller's console 60 can be connected to a processor 62. In embodiments, the directional driller's console and the processor can be connected to or in communication with the drilling bit locator.

A drill mode selector 89 can be mounted to the directional driller's console 60, which can be used to select drilling mode, such as a build mode or a straight drilling mode, to adjust a stroke count of a mud pump depending on the selected drilling mode, and to transmit the adjusted stroke count of the mud pump to a main driller's console.

The directional driller's console 60 can display an orienter speed 81, a string speed 83, a drift rate 85, an orienter ratio 281, an inclination 77, and an azimuth 79 on a display 65.

The directional driller's console 60 can include a toolface rosette 73 and an indicator light 75.

In embodiments, maximum drift angles 291 can be displayed on the toolface rosette 73.

Figure 9:
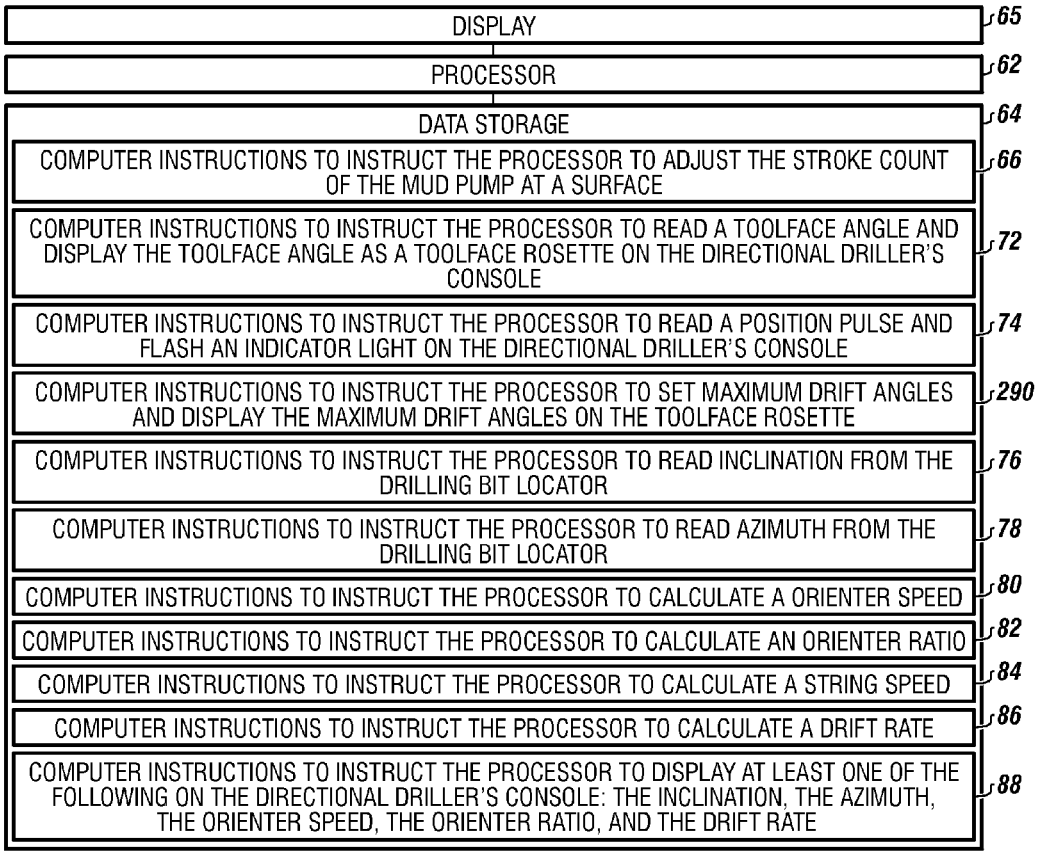
FIG. 9 depicts a processor and a data storage usable with the motor rotary steerable system according to one or more embodiments.

FIG. 9 depicts a processor and a data storage usable with the system according to one or more embodiments.

The directional driller's console can be connected to the processor 62, wherein the processor 62 can have a data storage 64 and a display 65.

The term "data storage" refers to a non-transitory computer readable medium, such as a hard disk drive, solid state drive, flash drive, tape drive, and the like. The term "non-transitory computer readable medium" excludes any transitory signals but includes any non-transitory data storage circuitry, e.g., buffers, cache, and queues, within transceivers of transitory signals.

The data storage 64 can have computer instructions 66 to instruct the processor to adjust the stroke count of the mud pump at a surface.

The data storage can contain computer instructions 72 to instruct the processor to read a toolface angle and display the toolface angle as a toolface rosette on the directional driller's console 60.

The data storage can contain computer instructions 74 to instruct the processor to read a position pulse and flash an indicator light on the directional driller's console.

The data storage can contain computer instructions 290 to instruct the processor to set the maximum drift angles and display the maximum drift angles on the toolface rosette.

The data storage can contain computer instructions 76 to instruct the processor to read the inclination from the drilling bit locator.

The data storage can contain computer instructions 78 to instruct the processor to read the azimuth from the drilling bit locator.

The data storage can contain computer instructions 80 to instruct the processor to calculate an orienter speed.

The data storage can contain computer instructions 82 to instruct the processor to calculate an orienter ratio.

The data storage can contain computer instructions 84 to instruct the processor to calculate a string speed.

The data storage can contain computer instructions 86 to instruct the processor to calculate a drift rate.

The data storage can contain computer instructions 88 to instruct the processor to display at least one of the following on the directional driller's console: the inclination, the azimuth, the orienter speed, the orienter ratio, and the drift rate.

In embodiments, the orienting device can include a gamma ray projection and detection device, a porosity detection device, a short hop sending device, and a power supply.

In embodiments, the motor rotary steerable system can have a pair of planetary gears which each can have a plurality of planet gears, a carrier connected to the plurality of planet gears, a sun gear surrounded by the plurality of planet gears and the carrier, and a ring gear surrounding the plurality of planet gears.

In embodiments, the motor rotary steerable system can have a first sun gear driven by the sun gear shaft, a first ring gear attached to the power section, wherein the first ring gear is fixed and a first carrier driven in the same direction as the first sun gear, wherein the first sun gear is configured to engage the adjustable slip clutch assembly.

Additionally, in this embodiment a second sun gear can be driven by the first ring gear, a second carrier can be fixed, and a second ring gear can be driven in a direction opposite to the first sun gear.

In embodiments, the directional driller's console can be connected to the processor, wherein the processor can communicate with the drilling bit locator of the orienting device, and the data storage can contain computer instructions to instruct the processor to adjust a drill mode selector mounted to the directional driller's console to select a build mode or a straight drilling mode to adjust a stroke count of the mud pump depending on a selected drilling mode and to transmit the adjusted stroke count of the mud pump to a main driller's console.

In embodiments, the motor rotary steerable system data storage can have a plurality of computer instructions to instruct the processor to read a toolface angle and display the toolface angle as a toolface rosette on the directional driller's console, read a position pulse and flash an indicator light on the directional driller's console, set the maximum drift angles and display the maximum drift angles on the toolface rosette, read the inclination from the drilling bit locator, read the azimuth from the drilling bit locator, calculate orienter speed, orienter ratio, string speed and drift rate.

In embodiments, the motor rotary steerable system data storage can have a plurality of computer instructions to instruct the processor to display at least one of: an inclination, an azimuth, an orientor speed, an orienter ratio and a drift rate on the directional driller's console.

In embodiments, a high side position sensor can be attached to the drilling bit locator which can be configured to transmit a signal to activate an indicator light when magnetic north is aligned with a high side of the bent sub.

In a different embodiment of the motor rotary steerable system for directional drilling of sub-surface formations with a rotating drill bit, the motor rotary steerable system can have a sun gear shaft rotated by the rotating drive shaft, a pair of planetary gears rotated in a clockwise rotation by the rotating drive shaft of a power section and the sun gear shaft, an adjustable slip clutch assembly rotated by the pair of planetary gears in the counterclockwise rotation and an orienting device connected to the pair of planetary gears through the adjustable slip clutch assembly.

In this embodiment, the orienting device can be configured to rotate in a counterclockwise rotation.

The orienting device can include a bent sub in this embodiment.

The bent sub can have a bent sub housing. A bearing section, a bit drive assembly, a pulse counter and a drilling bit locator can be in the bent sub housing.

In embodiments, the pulse counter can count the rotating drive shaft rotations in the bent sub housing.

In embodiments, the motor rotary steerable system can include an orienter extension assembly rotatable with the orienting device.

The orienter extension assembly can have a sleeve, which can be a data sleeve, surrounding the orienting device, an electronics pod with a measurement while drilling device with the drilling bit locator, and a plurality of rotatable electrical contact brushes for transmitting data from the drilling bit locator.

In embodiments, the orienting device can include an electronics sub positioned between the power section and the measurement while drilling device.

In embodiments, the electronics sub can include an additional pulse counter to count the orienter extension assembly rotations, a high side position sensor configured to transmit a signal to activate an indicator light when magnetic north is aligned with a high side of the bent sub, a plurality of rotatable electrical contact rings disposed in the electronics sub configured to align with the plurality of rotatable electrical contact brushes in the electronics pod, and a wiring harness providing an electrical interface between the electronics sub and the drilling bit locator.

In this embodiment, the orienting device can be rotated independently from the drill string. The orienting device can be geosynchronously timed to the rotation of the drill string to allow the drill string to rotate continuously while producing both straight and curved bore path segments to smooth a wellbore and increase production rates from the wellbore.

While these embodiments have been described with emphasis on the embodiments, it should be understood that within the scope of the appended claims, the embodiments might be practiced other than as specifically described herein.

What is claimed is:

1. A motor rotary steerable system for directional drilling of sub-surface formations with a rotating drill bit, the motor rotary steerable system positioned between a power section with a rotating drive shaft secured to a drill string and a bent sub, the motor rotary steerable system comprising:

a) a sun gear shaft;

b) a pair of planetary gears rotated by the rotating drive shaft of the power section and the sun gear shaft;

c) an adjustable slip clutch assembly rotated by the pair of planetary gears in a direction opposite a rotation of the pair of planetary gears; and d) an orienting device connected to the pair of planetary gears, wherein the orienting device is configured to rotate and engage with the adjustable slip clutch assembly, wherein the orienting device comprises a bent sub comprising:

i) a bent sub housing;

ii) a bearing section;

iii) a bit drive assembly;

iv) a pulse counter to count the rotating drive shaft rotations;

v) a drilling bit locator, wherein the drilling bit locator performs measurement while drilling; and vi) a transmitting device to convey signals from the orienting device to a receiver; and wherein the orienting device is rotated independently from the drill string; and wherein the orienting device is synchronously timed to the rotation of the drill string to allow the drill string to rotate continuously while producing both straight and curved bore path segments to smooth a wellbore and increase production rates from the wellbore.

2. The motor rotary steerable system of claim 1, wherein the orienting device includes a gamma ray projection and detection device, a porosity detection device, a short hop sending device, and a power supply.

3. The motor rotary steerable system of claim 1, wherein the pair of planetary gears each comprise:

a) a plurality of planet gears;

b) a carrier connected to at least one planet gear of the plurality of planet gears;

c) a sun gear surrounded by the plurality of planet gears and the carrier; and d) a ring gear surrounding the plurality of planet gears.

4. The motor rotary steerable system of claim 3, wherein a first sun gear is driven by the sun gear shaft, a first ring gear is attached to the power section, and a first carrier is driven in the same direction as the first sun gear, wherein the first sun gear is configured to engage the adjustable slip clutch assembly and wherein a second sun gear is driven by the first ring gear, a second carrier is driven, and the second ring gear is driven in a direction opposite to the first sun gear.

5. The motor rotary steerable system of claim 1, wherein the adjustable slip clutch assembly comprises:

a) a plurality of pressure plates;

b) a plurality of friction plates engaging the plurality of pressure plates; and c) a plurality of biasing means positioned between the plurality of pressure plates and the plurality of friction plates, wherein at least one biasing means of the plurality of biasing means collapses when pressure is applied to the plurality of pressure plates.

6. The motor rotary steerable system of claim 1, comprising a directional driller's console connected to a processor with a data storage and a display, the processor communicating with the drilling bit locator of the orienting device, the data storage having computer instructions to instruct the processor to adjust a drill mode selector mounted to the directional driller's console, to select a build mode or a straight drilling mode to adjust a stroke count of a mud pump depending on a selected drilling mode and to transmit the adjusted stroke count of the mud pump to a main driller's console.

7. The motor rotary steerable system of claim 6, wherein the data storage comprises a plurality of computer instructions to instruct the processor to:

a) read a toolface angle and display the toolface angle as a toolface rosette on the directional driller's console;

b) read a position pulse and flash an indicator light on the directional driller's console;

c) set maximum drift angles and display the maximum drift angles on the toolface rosette;

d) read an inclination from the drilling bit locator;

e) read an azimuth from the drilling bit locator;

f) calculate an orienter speed;

g) calculate an orienter ratio;

h) calculate a string speed;

i) calculate a drift rate; and j) display at least one of:

i) the inclination on the directional driller's console;

ii) the azimuth on the directional driller's console;

iii) the orienter speed on the directional driller's console;

iv) the orienter ratio on the directional driller's console; and v) the drift rate on the directional driller's console.

8. The motor rotary steerable system of claim 1, comprising a high side position sensor in the drilling bit locator configured to transmit a signal to activate an indicator light when magnetic north is aligned with a high side of the bent sub.

9. A motor rotary steerable system for directional drilling of sub-surface formations with a rotating drill bit, the motor rotary steerable system positioned between a power section with a rotating drive shaft secured to a drill string and a bent sub, the motor rotary steerable system comprising:

a) a sun gear shaft rotated by the rotating drive shaft;

b) a pair of planetary gears rotated by the rotating drive shaft of the power section and the sun gear shaft;

c) an adjustable slip clutch assembly rotated by the pair of planetary gears in a direction opposite a rotation of the pair of planetary gears;

d) an orienting device connected to the pair of planetary gears through the adjustable slip clutch assembly, the orienting device configured to rotate in a direction opposite the rotation of the pair of planetary gears, the orienting device comprising:

e) a bent sub comprising:

i) a bent sub housing;

ii) a bearing section in the bent sub housing;

iii) a bit drive assembly in the bent sub housing;

iv) a pulse counter to count the rotating drive shaft rotations in the bent sub housing; and v) a drilling bit locator disposed in the bent sub housing;

f) an orienter extension assembly rotatable with the orienting device, the orienter extension assembly comprising:

i) a sleeve surrounding the orienting device;

ii) an electronics pod comprising:

1) a measurement while drilling device with the drilling bit locator; and 2) a plurality of rotatable electrical contact brushes for transmitting data from the drilling bit locator;

iii) an electronics sub positioned between the power section and the measurement while drilling device, the electronics sub comprising:

1) an additional pulse counter to count the orienter extension assembly rotations;

2) a high side position sensor configured to transmit a signal to activate an indicator light when magnetic north is aligned with a high side of the bent sub; and 3) a plurality of rotatable electrical contact rings disposed in the electronics sub configured to align with the plurality of rotatable electrical contact brushes in the electronics pod; and 4) a wiring harness providing an electrical interface between the electronics sub and the drilling bit locator; and wherein the orienting device is rotated independently from the drill string, and wherein the orienting device is synchronously timed to the rotation of the drill string to allow the drill string to rotate continuously while producing both straight and curved bore path segments to smooth a wellbore and increase production rates from the wellbore.

10. The motor rotary steerable system of claim 9, wherein the pair of planetary gears each comprise:

a) a plurality of planet gears;

b) a carrier connected to at least one planet gear of the plurality of planet gears;

c) a sun gear surrounded by the plurality of planet gears and the carrier; and d) a ring gear surrounding the plurality of planet gears.

11. The motor rotary steerable system of claim 10, wherein a first sun gear is driven by the sun gear shaft, a first ring gear is attached to the power section and is fixed, and a first carrier is driven in the same direction as the first sun gear, wherein the first sun gear is configured to engage the adjustable slip clutch assembly and wherein a second sun gear is driven by the first ring gear, a second carrier is fixed, and the second ring gear is driven in a direction opposite to the first sun gear.

12. The motor rotary steerable system of claim 9, wherein the adjustable slip clutch assembly comprises:

a) a plurality of pressure plates;

b) a plurality of friction plates engaging the plurality of pressure plates; and c) a plurality of biasing means positioned between the plurality of pressure plates and the plurality of friction plates, wherein at least one biasing means of the plurality of biasing means collapses when pressure is applied to the plurality of pressure plates.

13. The motor rotary steerable system of claim 9, comprising a directional driller's console connected to a processor with a data storage and a display, the processor communicating with the drilling bit locator of the orienting device, the data storage having computer instructions to instruct the processor to adjust a drill mode selector mounted to the directional driller's console, to select a build mode or a straight drilling mode to adjust a stroke count of a mud pump depending on a selected drilling mode and to transmit the adjusted stroke count of the mud pump to a main driller's console.

14. The motor rotary steerable system of claim 13, the data storage comprising a plurality of computer instructions to instruct the processor to:

a) read a toolface angle and display the toolface angle as a toolface rosette on the directional driller's console;

b) read a position pulse and flash an indicator light on the directional driller's console;

c) set maximum drift angles and display the maximum drift angles on the toolface rosette;

d) read an inclination from the drilling bit locator;

e) read an azimuth from the drilling bit locator;

f) calculate an orienter speed;

g) calculate an orienter ratio;

h) calculate a string speed;

i) calculate a drift rate; and j) display at least one of:

i) the inclination on the directional driller's console;

ii) the azimuth on the directional driller's console;

iii) the orienter speed on the directional driller's console;

iv) the orienter ratio on the directional driller's console; and v) the drift rate on the directional driller's console.

* * * * *